US006174380B1

(12) United States Patent
Rosenzweig et al.

(10) Patent No.: US 6,174,380 B1
(45) Date of Patent: Jan. 16, 2001

(54) METHOD OF REMOVING HOT CORROSION PRODUCTS FROM A DIFFUSION ALUMINIDE COATING

(75) Inventors: Mark A. Rosenzweig; Jeffrey A. Conner, both of Hamilton; Joseph H. Bowden, Jr., Mason, all of OH (US)

(73) Assignee: General Electric Company, Cincinnati, OH (US)

( * ) Notice: Under 35 U.S.C. 154(b), the term of this patent shall be extended for 0 days.

(21) Appl. No.: 09/219,153

(22) Filed: Dec. 22, 1998

(51) Int. Cl.[7] ..... B08B 3/12; C23G 1/02

(52) U.S. Cl. ..... 134/1; 134/3; 134/28; 134/41

(58) Field of Search ..... 134/1, 3, 28, 41

(56) References Cited

U.S. PATENT DOCUMENTS

| | | | | |
|---|---|---|---|---|
| 3,607,398 | | 9/1971 | Lucas | 134/3 |
| 3,997,361 | | 12/1976 | Kendall | 134/28 |
| 4,119,437 | | 10/1978 | Arendt et al. | 134/3 |
| 4,289,576 | | 9/1981 | Wilson | 156/667 |
| 4,317,685 | * | 3/1982 | Ahuja et al. | 134/3 |
| 4,439,241 | * | 3/1984 | Ault et al. | 134/22.17 |
| 4,639,327 | | 1/1987 | McGaha | 252/143 |
| 4,707,191 | | 11/1987 | Martinou et al. | 134/3 |
| 5,275,671 | | 1/1994 | Rivenaes | 148/248 |
| 5,575,858 | | 11/1996 | Chen et al. | 134/3 |
| 5,938,855 | * | 8/1999 | Bowden, Jr. | 134/1 |

OTHER PUBLICATIONS

U.S application Ser. No. 09/009,236, Bowden, filed Jan. 20, 1998.

* cited by examiner

*Primary Examiner*—Randy Gulakowski
*Assistant Examiner*—Saeed Chaudhry
(74) *Attorney, Agent, or Firm*—Andrew C. Hess; Gerry S. Gressel

(57) ABSTRACT

A method of removing hot corrosion products from the surface of a component exposed to corrosive conditions at elevated temperatures, as is the case with turbine, combustor or augmentor components of gas turbine engines. The method is particularly suited for the removal of hot corrosion products from components protected with a diffusion aluminide coating, either as an environmental coating or as a bond coat for a thermal barrier coating (TBC). The processing steps of the method include immersing the component in a heated liquid solution containing acetic acid, and then agitating the surfaces of the component while the component remains immersed in the solution. In this manner, hot corrosion products on the surfaces of the component are removed without damaging or removing the diffusion aluminide coating. As a result, regions of the component from which the hot corrosion products were removed can then be repaired by a suitable aluminizing process.

18 Claims, No Drawings

METHOD OF REMOVING HOT CORROSION PRODUCTS FROM A DIFFUSION ALUMINIDE COATING

FIELD OF THE INVENTION

This invention relates to methods for repairing gas turbine engine components protected by diffusion aluminide coatings. More particularly, this invention is directed to a process by which hot corrosion products are removed from a diffusion aluminide coating without damaging the coating, and therefore enables the coating to be rejuvenated instead of being completely removed and replaced.

BACKGROUND OF THE INVENTION

The operating environment within a gas turbine engine is both thermally and chemically hostile. Significant advances in high temperature alloys have been achieved through the formulation of iron, nickel and cobalt-base superalloys, though components formed from such alloys often cannot withstand long service exposures if located in certain sections of a gas turbine engine, such as the turbine, combustor and augmentor. A common solution is to protect the surfaces of such components with an environmental coating, i.e., a coating that is resistant to oxidation and hot corrosion. Coatings that have found wide use for this purpose include diffusion aluminide coatings and overlay coatings such as MCrAlY (where M is iron, nickel and/or cobalt), which may be overcoated with a diffused aluminide coating. During high temperature exposure in air, these coatings form a protective aluminum oxide (alumina) scale that inhibits oxidation of the coating and the underlying substrate. Diffusion aluminide coatings are particularly useful for providing environmental protection to components equipped with internal cooling passages, such as high pressure turbine blades, because aluminides are able to provide environmental protection without significantly reducing the cross-sections of the cooling passages. As known in the art, diffusion aluminide coatings are the result of a reaction with an aluminum-containing composition at the component surface. The reaction forms two distinct zones, an outermost of which is termed an additive layer that contains the environmentally-resistant intermetallic phase MAl, where M is iron, nickel or cobalt, depending on the substrate material. Beneath the additive layer is a diffusion zone containing various intermetallic and metastable phases that form during the coating reaction as a result of diffusional gradients and changes in elemental solubility in the local region of the substrate.

Hot corrosion of gas turbine engine components generally occurs when sulfur and sodium react during combustion to form sodium sulfate ($Na_2SO_4$), which condenses on and subsequently attacks the components' surfaces. Sources of sulfur and sodium for hot corrosion reactions include impurities in the fuel being combusted as well as the intake of sodium laden dust and/or ingestion of sea salt. In the latter situation, hot corrosion typically occurs on hot section turbine blades and vanes under conditions where salt deposits on the component surface as a solid or liquid. The salt deposits can break down the protective alumina scale on the aluminide coating, resulting in rapid attack of the coating. Hot corrosion produces a loosely adherent external scale with various internal oxides and sulfides penetrating below the external scale. These products are generally sulfur and sodium compounds with elements present in the alloy and possibly other elements from the environment, such as calcium, magnesium, chlorine, etc. As such, hot corrosion products are distinguishable from oxides that normally form or are deposited on gas turbine engine components as a result of the oxidizing environment to which they are exposed.

Traditionally, aluminide coatings have been completely removed to allow component repair by welding or brazing or to replace damaged coating, after which a new aluminide coating is applied by any suitable aluminizing process. Any hot corrosion products present in the coating are removed with the coating. A disadvantage of completely removing an aluminide coating from a gas turbine engine component is that a portion of the substrate metal is removed with the coating, which significantly shortens the useful life of the component. As a result, new repair technologies have been proposed by which diffusion aluminide coatings are not removed, but instead are rejuvenated to restore the aluminide coating and the environmental protection provided by such coatings. However, coating rejuvenation technologies for turbine blade and vane repair cannot be performed in the presence of hot corrosion products, since any remaining hot corrosion products would result in attack of the rejuvenated coating upon exposure to engine temperatures. Because hot corrosion products have required removal by abrasive grit blasting, rejuvenation technologies have been limited to components that have not been attacked by hot corrosion.

From the above, it can be appreciated that, in order to successfully implement a rejuvenation program for turbine engine components having diffusion aluminide coatings that are exposed to sea salt and other sources of sulfur and sodium, hot corrosion products must be removed without damaging the aluminide coatings. Treatments with caustic solutions in autoclaves have been successfully used to remove oxides of aluminum and nickel from components, but such treatments have not been successful at removing hot corrosion products for the apparent reason that the more complex hot corrosion products are not soluble in caustic solutions. Accordingly, the prior art lacks a process by which hot corrosion products can be completely removed without damaging or removing a diffusion aluminide coating.

SUMMARY OF THE INVENTION

The present invention provides a method of removing hot corrosion products from the surface of a component exposed to salt solutions and other sources of sodium and sulfur at extremely high temperatures, as is the case with turbine, combustor or augmentor components of gas turbine engines. The method is particularly suited for the removal of hot corrosion products from components protected with a diffusion aluminide coating, either as an environmental coating or as a bond coat for a thermal barrier coating (TBC).

The processing steps of this invention generally include conditioning or activating the surface to be cleaned by processing through caustic autoclave and/or grit blasting operations, immersing the component in a heated liquid solution containing acetic acid, and then agitating the surfaces of the component while the component remains immersed in the solution. In this manner, it has been determined that hot corrosion products on the surfaces of the component are removed without damaging or removing the diffusion aluminide coating. As a result, regions of the component from which the hot corrosion products were removed can then be repaired by a suitable rejuvenating process. If desired, the component can be pretreated by autoclaving with a caustic solution to remove oxides from the surface of the component. Such an autoclaving treatment can be followed by water jet stripping to remove a TBC (if any) adhered to the component with the aluminide coating.

According to this invention, weak acetic acid solutions such as white vinegar have been unexpectedly found to remove hot corrosion products if used at certain temperatures and supplemented with sufficient agitation following a surface conditioning or activation step. Advantageously, such weak acetic acid solutions have been found not to attack aluminide coatings, permitting rejuvenation of an aluminide coating instead of complete removal of the coating and then application of a new coating. Another advantage of this invention is that acetic acid does not foul wastewater treatment facilities, and can be disposed of without concern for exceeding allowable levels for metal ion concentrations in wastewater. Accordingly, the treatment of this invention is environmentally friendly.

Other objects and advantages of this invention will be better appreciated from the following detailed description.

DETAILED DESCRIPTION OF THE INVENTION

The present invention provides an uncomplicated and environmentally safe method for removing hot corrosion products contained within aluminide coatings on the surfaces of gas turbine engine components subjected at high temperatures to sources of sodium and sulfur, including fuels, dust and sea water. Notable examples of such components include the high and low pressure turbine nozzles and blades, shrouds, combustor liners and augmentor hardware of gas turbine engines. Of particular interest to the invention are gas turbine engine components protected with a diffusion aluminide coating or a MCrAlY coating overcoated with a diffused aluminide coating, which may or may not be accompanied by a ceramic topcoat as a TBC. While the advantages of this invention will be described with reference to gas turbine engine components, the invention is generally applicable to any component having an aluminized surface that would benefit from being rejuvenated without removal of the existing aluminide coating.

The method of this invention entails treating an aluminized surface attacked by hot corrosion with a weak acetic acid solution, an example of which is white vinegar typically containing about 4 to 8 weight percent acetic acid. While copending and commonly-assigned U.S. patent application Ser. No. 09/009,236 to Bowden discloses that vinegar has been found to remove dirt and silica and calcium-based compounds from gas turbine engine components, the ability of vinegar and other weak acetic acid solutions to remove complex hot corrosion products chemically bonded to an aluminide coating was unknown and unexpected. According to this invention, a weak acetic acid solution in combination with a suitable surface pretreatment has been surprisingly determined to completely remove hot corrosion products without damaging or removing those portions of the coating that have not been attacked by hot corrosion. While vinegar is generally preferred as the treatment solution of this invention due to availability and cost, it is foreseeable that stronger and weaker acetic acid solutions derived by other methods could be used.

The process of this invention preferably entails processing a component through a suitable surface pretreatment, immersing the component in an acetic acid solution at about 150° F. to about 175° F. (about 66° C. to about 79° C.), though temperatures between about 120° F. and 200° F. (about 49° C. and about 93° C.) are believed to be suitable. While different solution strengths are possible, preferred acetic acid concentrations for the solution are about 4% to about 5%. Complete immersion of the component ensures that all surfaces, including any internal surfaces such as those formed by cooling passages, are contacted by the solution. The surfaces of the component are then agitated, such as by ultrasonic energy, to dislodge the hot corrosion products from the component surfaces. Suitable parameters for an ultrasonic cleaning operation can be readily ascertainable by those skilled in the art, with shorter durations being possible when the component is subjected to higher ultrasonic energy levels. Generally, a two-hour duration using a commercially-available ultrasonic cleaner has been found to be sufficient to remove a majority of the hot corrosion products chemically bonded to an aluminide coating. A preferred treatment is about two to about four hours to ensure complete removal of hot corrosion products. Following ultrasonic cleaning, the component is rinsed with water or another suitable rinse to remove the acetic acid solution from the internal and external surfaces of the component. The component is then ready for rejuvenation of its aluminide coating by any suitable aluminizing process. During rejuvenation, diffusion aluminide is redeposited on those regions from which hot corrosion products were removed. Prior to rejuvenation, these regions are characterized by the absence of the additive layer of the original aluminide coating, though the diffusion zone remains.

The investigation leading to this invention involved the treatment of high pressure turbine blades protected with diffusion aluminide environmental coatings that had been attacked by hot corrosion, which appeared as a blue-gray coloration on the surfaces of the blades. Each blade was first pretreated by autoclaving at between 150° C. and 250° C. and a pressure of between 100 and 3000 psi (about 0.7 to about 21 MPa) with a caustic solution containing sodium hydroxide. While autoclaving successfully dissolved engine oxides from the blades, hot corrosion products remained firmly adhered to the aluminide coatings, particularly on the concave surfaces of the blades. The turbine blades were then immersed tip-down in a container of undiluted white vinegar at a temperature of about 65° C. (about 150° F.) The container and blades were then subjected to ultrasonic agitation for a total of two hours, after which the blades were rinsed with tap water.

After the above treatment, and without any additional processing (e.g., grit blasting or tumbling), it was observed that the blue-gray colored hot corrosion product had been completely removed from two of the three blades. The hot corrosion product was completely removed from the third blade by light grit blasting that did not damage the aluminide coating on the blade surface. Metallurgical examination of the blades showed that the heated vinegar solution had reacted with and completely removed the corrosion product, which had been present in the additive layer of the coating. Importantly, the vinegar solution did not attack those uncorroded regions of the coating immediately adjacent those regions from which hot corrosion products were removed. As a result, the blades were in condition for rejuvenation of their aluminide coatings.

Following the success of the above results, additional testing was performed on a second group of high pressure turbine blades whose diffusion aluminide environmental coatings had been similarly attacked by hot corrosion. Instead of an autoclave pretreatment, each blade was first pretreated by grit blasting to clean the surfaces of the blades. These blades were also immersed tip-down in a container of undiluted white vinegar at a temperature of about 65° C. (about 150° F.), subjected to ultrasonic agitation for a total of two hours, and then rinsed with tap water. Inspection of the blades after rinsing showed that the hot corrosion product had been completely removed from all of the blades.

From the above results, it was concluded that vinegar and other weak acetic acid solutions can be used to clean and remove hot corrosion products and oxides from aluminized surfaces without damaging the aluminide coating. It was further concluded that treatment with the weak acetic acid solution is best carried out with a caustic autoclave process or grit blasting as a surface conditioning or activation pretreatment to enhance the removal of oxides of the type that form as a result of the oxidizing operating environment within a gas turbine engine. Suitable autoclaving conditions are believed to include the use of sodium hydroxide as the caustic solution using conventional autoclaving pressures and temperatures. In addition, it was concluded that the acetic acid treatment of this invention can be used in conjunction with caustic autoclave stripping to first remove a ceramic TBC on a diffusion aluminide coating (in which case, the coating serves as a bond coat for the TBC), and then remove hot corrosion products from the exposed aluminide coating. This latter procedure can also include water jet stripping the TBC in accordance with U.S. patent application Ser. No. 08/886,504, which is incorporated herein by reference.

While the invention has been described in terms of a preferred embodiment, it is apparent that other forms could be adopted by one skilled in the art. For example, suitable acetic acid solutions could contain other constituents, both inert and active. Accordingly, the scope of the invention is to be limited only by the following claims.

What is claimed is:

1. A method for removing hot corrosion products from the surface of a gas turbine engine component protected by a diffusion aluminide coating that comprises an additive layer on the surface of the component and a diffusion zone in the surface of the component, the method comprising the steps of:

immersing the component in a liquid solution containing an acidic fraction consisting of acetic acid; and then agitating the surface of the component while immersed in the solution so that the hot corrosion products on the surface of the component are removed without damaging or removing the diffusion zone of the diffusion aluminide coating; and then aluminizing the surface of the component to repair regions of the surface from which the hot corrosion products were removed.

2. A method as recited in claim 1, wherein the solution comprises an acidic fraction that consists essentially of acetic acid.

3. A method as recited in claim 2, further comprising the step of rinsing the solution from the surface of the component prior to the aluminizing step.

4. A method as recited in claim 1, wherein the component is immersed in the solution for at least two hours.

5. A method as recited in claim 1, wherein the solution is maintained at about 150° F. to about 175° F. during the agitation step.

6. A method as recited in claim 1, wherein the agitation step is performed by subjecting the component to ultrasonic energy.

7. A method as recited in claim 1, further comprising the step of, prior to the immersion step, subjecting the component to a caustic solution at a pressure of about 100 psi to about 3000 psi and at a temperature of about 150° C. to about 250° C. to remove oxides from the surface of the component.

8. A method as recited in claim 7, wherein a ceramic coating overlies the diffusion aluminide coating on the surface of the component, the method further comprising the step of, following the step of subjecting the component to the caustic solution but prior to the immersion step, subjecting the component to water jet stripping to remove the ceramic coating from the component.

9. A method as recited in claim 1, further comprising the step of, prior to the immersion step, grit blasting the surface of the component.

10. A method as recited in claim 1, wherein all hot corrosion products on the surface of the component are removed during the agitation step.

11. A method as recited in claim 1, wherein the component is a turbine blade.

12. A method for removing hot corrosion products from the surface of a gas turbine engine component protected by a diffusion aluminide coating that comprises an additive layer on the surface of the component and a diffusion zone in the surface of the component, the method comprising the steps of:

conditioning the surface of the component by a technique selected from the group consisting of caustic treatments and grit blasting;

immersing the component in a bath consisting of white vinegar at a temperature of about 150° F. to about 175° F.;

agitating the surface of the component with ultrasonic energy while the component is immersed in the bath for a duration sufficient to cause removal of the hot corrosion products on the surface of the component without damaging or removing the diffusion zone of the diffusion aluminide coating;

removing the component from the bath and rinsing any residual white vinegar from the surface of the component; and then without removing the diffusion zone of the diffusion aluminide coating, aluminizing the surface of the component to repair regions of the surface from which the hot corrosion products were removed.

13. A method as recited in claim 12, wherein the bath contains about 4 to 5 weight percent acetic acid.

14. A method as recited in claim 12, wherein the component is immersed in the bath for at least two hours.

15. A method as recited in claim 12, wherein the conditioning step comprises subjecting the component to a caustic solution at a pressure of about 100 psi to about 3000 psi and at a temperature of about 150° C. to about 250° C. to remove oxides from the surface of the component.

16. A method as recited in claim 15, wherein a ceramic coating overlies the diffusion aluminide coating on the surface of the component, the method further comprising the step of, following the step of subjecting the component to the caustic solution but prior to the immersion step, subjecting the component to water jet stripping to remove the ceramic coating from the component.

17. A method as recited in claim 12, all hot corrosion products on the surface of the component are removed during the agitation step.

18. A method as recited in claim 12, wherein the component is a turbine blade.

* * * * *